US005230841A

United States Patent [19]

Redecker et al.

[11] Patent Number: 5,230,841

[45] Date of Patent: Jul. 27, 1993

[54] METHOD FOR PREPARATION OF POROUS PROPELLANTS

[75] Inventors: Klaus Redecker, Nuremberg; Horst Penner, Furth, both of Fed. Rep. of Germany

[73] Assignee: Dynamit Nobel Aktiengesellschaft, Troisdorg, Fed. Rep. of Germany

[21] Appl. No.: 943,657

[22] Filed: Aug. 2, 1978

[30] Foreign Application Priority Data

Aug. 2, 1977 [DE] Fed. Rep. of Germany ..... 2734779

[51] Int. Cl.[5] ..... C06B 21/00; C06B 45/00

[52] U.S. Cl. ..... 264/3.1; 149/2; 149/19.92; 149/109.6; 102/431

[58] Field of Search ..... 102/38 CC, 431; 149/2, 149/2 F, 19.92, 109.6; 264/3 R, 3.1

[56] References Cited

U.S. PATENT DOCUMENTS

| | | | |
|---|---|---|---|
| 3,673,286 | 7/1972 | Remaly et al. | 149/2 X |
| 3,722,410 | 3/1973 | Hurst | 149/2 |
| 3,830,672 | 8/1974 | Lista | 149/2 |
| 3,854,400 | 12/1974 | Langehoven | 102/38 CC |
| 4,023,996 | 5/1977 | Leneveu | 102/38 CC |
| 4,093,478 | 6/1978 | Hurst | 149/2 |
| 4,758,287 | 7/1988 | Pietz | 264/3.1 |

OTHER PUBLICATIONS

The Condensed Chemical Dictionary, Reinhold Pub. Corp., New York 1956, p. 896 (QD5 C5).

*Primary Examiner*—Edward A. Miller

*Attorney, Agent, or Firm*—Antonelli, Terry, Stout & Kraus

[57] ABSTRACT

A method for producing porous propellant charges from a mixture containing a propellant and a filler is described wherein a propellant having a decomposition temperature above 200° C. is employed with a thermally removable filler to provide the charge forming mixture. The mixture is molded into a charge body and is subsequently heated to remove the filler at a temperature that is at least 50° C. below the decomposition temperature of the propellant. Due to the heating at the elevated temperature the filler is wholly or in part removed to form a cavity within the charge body.

7 Claims, No Drawings

METHOD FOR PREPARATION OF POROUS PROPELLANTS

The subject of the present invention is a method for preparation of porous propellant compounds, more particularly for cartridgeless ammunition from a mixture containing propellant and filler whereby the filler is solid at ambient temperature, owing to molding and subsequent removal of the filler.

It is known from DT-PS 75 822 how to make nitrocellulose powder porous by the addition of water-soluble metal nitrates in order to increase the combustion rate. The degree of porosity is hereby directly proportional to the quantity of the substance added and again removed. The extraction of the fillers nevertheless only takes place so long as the nitrocellulose is in the solvent-wet swollen state.

Cartridgeless propellant charges on a nitrocellulose base are independently known. They display the advantage of low weight and, in their preparation, less operational sequences accumulate than in the case of conventional ammunition. The handling of such types of cartridgeless propellant charges offers, however, difficulties inasmuch as the propellant compound easily decomposes and crumb structure forms. In addition, they do not possess a sufficient resistance to dampness.

In order to remove these disadvantages, DT-AS 1 796 283 describes a method whereby the required stability of the propellant is increased in that a wet and doughy poured propellant on a nitrocellulose base is provided with a cellulose binding agent and subsequently is allowed to harden. At the same time, the porosity in the propellant compound is achieved by evaporation of the added water and/or solvent. This method nevertheless has the disadvantage that solely by evaporating water and/or solvents as well as notwithstanding possibly added fillers, owing to the simultaneous presence of solvents which these fillers dissolve, the adjustment of a specified porosity is not possible in the case of a subsequent washing process for example.

It has also already been proposed to use as propellant powder for cartridgeless ammunition secondary, fine-ground explosives with a high cookoff temperature (above ca. 200° C.) together with desensitizing acting binding agents. These explosive/binding agent mixtures can nevertheless not replace nitrocellulose propellant charge mixtures as propellant charge powder since they in no way even approximately achieve the favorable internal ballistic burning properties of nitrocellulose propellant charge mixtures. These explosive/binding agent mixtures show, in the case of a too high proportion of binding agent, the disadvantage that the burning almost comes to a stop as a result of the desensitizing effect of the binding agent so that no satisfactory pressure buildup occurs in the cartridge chamber. Further, the fact also acts disadvantageously that, in the cartridge chamber and also in the barrel of the weapon, unacceptable quantities of unburned combustion products (for example, soot) remain since the heat of explosion and the oxygen value of the propellant has been greatly reduced owing to increased quantities of binding agent.

A transfer of the method described in DT-PS 75 822 for increasing the combustion rate to the high temperature resistant propellant charge and binding agent is connected, however, with disadvantages. Conditioned by the small exchange surface with the elutriation of the filler, the method is time-consuming and leads to propellant charge losses even in the case of only slight solubility of the high temperature resistant propellant charge in the eluant owing to the long-lasting effect. It is further unsatisfactory that, in the distribution of the binder using a solvent in addition to the encasing of the propellant with binder which leads to especially solid propellant pellets, the filler to be eluated is likewise encased whereby its subsequent removal is made impossible.

The present invention has the task of making available a method with which it is possible to prepare porous propellants with high mechanical stability and with improved and reproducible ballistic data.

In satisfaction of this task, a method has been found for preparation of porous propellant compounds, more particularly for cartridgeless ammunition, from a mixture containing filler and propellant whereby the filler is solid at ambient temperature, through molding and subsequent removal of the filler which is characterized in that a high temperature resistant propellant is used as propellant and used as filler is one such which is removable wholly or in part owing to the effect of heat and providing a cavity.

The method in accordance with the invention has the advantage that, through the selection of particle size of the filler and particle count, the porosity of the propellant compound can be prepared on a reproducible basis. This makes possible control of fragmentation and combustion rate.

High temperature resistant propellants within the meaning of the invention are such having decomposition points above 200° C. In addition, propellant mixtures can be used.

Secondary explosives or explosive mixtures are given preference.

Among the propellants which can be used in accordance with the invention are, for example, organic nitrocompounds which are derived from mononuclear or polynuclear aromatic compounds.

Nitrated aromatic compounds are, for example, the di- and triamino compounds of symmetrical trinitrobenzol as well as their acylation products as for example 2,4,6,2',4',6'-hexanitrooxanilide or 2,4,6,2',4',6'-hexanitro-N,N'-diphenyl urea. In addition, nitrated aromatic compounds can be used which are connected with one another through carbon atoms or through sulfur, oxygen or nitrogen atoms.

Examples for such compounds are nitration products of diphenyl or 3,3'-diaminodiphenyl or of stilbene, for example hexanitrostilbene or diphenyloxide, for example hexanitrodiphenyloxide or diphenylsulfide, for example hexanitrodiphenylsulfide or diphenylsulfone, for example hexanitrodiphenylsulfone or of diphenylamine, for example hexanitrodiphenylamine and 3,3'-azobis(2,4,6,2',4',6'-hexanitrodiphenyl).

Belonging to the high temperature resistant propellants which are used in accordance with the invention are also heterocyclic compounds, which contain picryl residues, such as thiophene, 1,3-thiazol, s-triazine or pyrimidine and nitrated heterocyclic compounds such as 1,3,6,8-tetranitrocarbazol, 1,3,6,8-tetranitroacridon, further compounds such as tetronitro-2,3:5,6-dibenzo-1,3a,4,6a-tetraazapentalene.

Also included to the propellants usable within the meaning of the invention are nitramines, more particularly 1,3,5-trinito-1,3,5-triazacyclohexane (hexogen)

and 1,3,5,7-tetranitro-1,3,5,7-tetraazacyclooctane (octogen).

Also usable are nitric acid esters, for example on the basis of aromatic or heterocyclic or aliphatic nitrocompounds, for example 2,4,6,2',4',6'-hexanitrodiphenylaminoethylnitrate, pentaerythrittetranitrate.

Octogen, especially in its α-modification, is preferred as propellant.

The propellant is used individually or in mixture, generally with degrees of purity greater than 95%. For reasons of safety, the propellant proportion should amount advisably to a maximum of 95% by weight in the working (filling up to 100=binding agent).

The desired mechanical stability of the propellant compound can be adjusted with a suitable binding agent. Binding agents are, for example, thermoplastic polymers such as, for example, polymers on the polyvinylacetal base whereby lower aliphatic aldehydes with a carbon atom count of 1–6, more particularly butyraldehydes, are preferentially used as aldehydes. Also suitable are, however, polyurethane, polyester, poly(-meth)-acrylate or cellulose acetate.

The distribution of thermoplasts as binding agents in propellant powder/filler mixture can be undertaken mechanically or preferentially by means of a solvent dissolving the binder.

The application of a binding agent dissolved in a solvent guarantees a uniform enclosure of the propellant and filler particle. Following the mixing procedure may be the molding and/or compression to solid propellant compounds.

Further, bifunctional monomers or reaction-capable oligomers or polymers can be used as binding agent. During or after end of mixing with the propellant charge powder and filler or after mixing propellant charge with the filler and following molding, there can result a radically induced cross linkage or a condensation leading to a solid structure of the particle mixture.

Both the mixing process as well as the molding and/or compression take place at temperatures under those temperatures at which the filler is thermally removable.

Insofar as the propellant or propellant mixtures themselves have binding character, the utilization of the abovementioned polymer binding agents can be proportionally waived. Such propellants or propellant mixtures with decomposition points above 200° and with binding character can, for example, be propellant mixtures which contain up to 2% by weight of nitrocellulose.

The quantity to be used of binding agent can be varied from case to case depending on the desired mechanical stability of the propellant compound.

The quantity to be used of binding agent is also a function of the type of its distribution in the propellant/filler mixture. If the distribution of the granular substances takes place by screening the components, there will also be achieved at higher shaping temperatures, for example at molding temperatures, a lesser stability than when using one of the binding agents dissolved in a solvent. The ratio of propellant to binding agent is in the latter case generally between 95:5 to 80:20% by weight. When a propellant or a propellant mixture with binding properties is used or co-used, the propellant without binding character can be replaced by propellant with binding character in the ratio of 95:5 to 50:50.

The preparation of propellant compounds according to the invention generally takes place in the way that the powdery propellant as well as the powdery fillers as well as binding agents can be mixed through screens. The mixing can also take place with a swift-running stirrer whereby advisably a solvent inert for each one of the components such as, for example, gasoline or petroleum is used to support the homogeneous distribution. In this case, after a completed homogeneous distribution, the mixture has its solvent removed for example by filtering and subsequent drying. The fine distribution of components can also be undertaken in a kneader, if necessary with the additional help of a solvent dissolving the binders.

The deformation to the desired shaped bodies generally takes place by molding whereby the molding pressure ranges between 0.4 and 4 $Mp/cm^2$ depending on the binding agent used.

The molding temperature is adjusted to the binding agent and filler used. The molding temperature always is under the temperature at which the filler can be thermally removed and under the temperature at which the propellant or the propellant mixture as well as the binding agents are decomposed or thermally damaged.

Preferred are the propellant/filler-bearing as well as preferentially binding agent-bearing mixtures which were mixed with one of the solvents dissolving the binder, extrusion molded and cut up to granulate before the actual shaping by molding.

Solid granular fillers at ambient temperature are used according to the invention as fillers and which, with a temperature increase above ambient temperature after successful shaping under gas and/or vapor development, produce well-defined cavities in the propellant compound. At the same time, the gases and/or vapors will not disadvantageously affect in their function either the propellant or any binder which may still be present.

Understood as thermally removable substances within the meaning of the invention are, for example, those which are decomposed owing to the effect of heat in the sense of a chemical reaction in which are produced gaseous and/or vapory substances occasionally in addition to solid substances.

Thermally removable substances within the meaning of the invention are also such substances which are transformed without being decomposed, evaporated or distilled off or sublimated, accordingly by physical ways.

However, thermally decomposable organic substances such as, for example, thermounstable polymer particles are also usable as filler.

Also suited are such substances, for example, with which a welldefined shrinkage of the individual particle occurs owing to the effect of heat such as, for example, when releasing water of crystallization with bodies containing water of crystallization, for example minerals or metallic salts.

Fillers are also to be used consisting of mixtures of various substances solid at ambient temperature, for example mixture of acids and carbonates solid at ambient temperature and containing water of crystallization as well as hydrogen carbonates or sulfites in stoichiometric ratio with which at increased temperature there takes place a chemical reaction with gas separating off and clearing of a cavity.

Preferentially used are such fillers which without leaving behind essential residues in the cavities can be removed from the propellant compounds by the effect of heat. To these fillers belong more particularly ammonium carbonate, ammonium hydrogen carbonate and ammonium carbamate either individually or in mixture.

The utilization of ammonium hydrogen carbonate has proven to be especially advantageous herewith.

Fillers solid at ambient temperature which can be used in accordance with the invention and are transformed owing to the effect of heat into the gaseous or vaporous and thereby removable physical condition are, for example, α-chloracrylic acid, β, β-dichloracrylic acid, trans-1,2-diiodoethylene, 2,5-dimethylphenol, naphthaline, 2-oxybenzylalcohol, α-naphthol, o-phenylenediamine, fluoroanthrene, p-dichlorobenzol, γ-hexachlorocyclohexane and such like.

Further suitable fillers are, for example, also such substances which indeed leave behind cavities in the propellant compound depending on the particle size and the number of particles in the case of thermal treatment and even, however, in such a case their fission products can appear in reaction with the binding agent in gaseous or vaporous form, for example in the direction of a hardening of the binding agent used but still capable of reaction.

In addition, depolymerizable compounds can be used as fillers, for example metaldehyde whereby with a heating effect an in part monomoleuclar acetaldehyde reforms and simultaneously a sublimation takes place.

In addition, such substances are conceivable as fillers which indeed are not characteristic explosive substances but still are counted among the substances capable of explosion such as, for example, metal nitrates, ammonium nitrate, blowing agents for plastic and rubber industry, for example sulfohydrazides or organic peroxides which are utilized as polymerization catalysts in the plastic industry.

Such substances show a clear decomposition at such temperatures ranging far under the temperature of a possible explosion-type decomposition. For safety reasons, it is nevertheless indicated with such substances not to undertake the thermal treatment of the propellant compound at too high temperatures or over a rather lengthy period.

The thermal treatment of the propellant compound can take place at standard pressure or, if necessary, with use of a vacuum.

It goes without saying that the thermal treatment must be undertaken at temperatures under the decomposition point of the propellant or propellant mixtures and, if necessary, present binding agent.

For reasons of safety, the temperature used should range at least 50° C. under the decomposition point of the propellant. At the same time, it is also to be taken into consideration that the binding agent character of the binding agent if used may not be lost with the applied temperatures.

The filler is generally inserted in a concentration of 1 to 30% by weight referred to the total mixture.

Depending on the average particle size of the filler used and depending on the type and quantity of the binding agent used, the quantity of filler to be used can also amount to 5 to 15% by weight with respect to the total mixture.

The particle size range of the fillers used ranges generally at <500 μm and preferentially at <400 μm.

It has been shown that particle sizes with a comparatively narrow particle spectrum are especially well suited, more particularly particle sizes in the range from >100 to <200 μm.

The average particle sizes of the propellant used and the polymer binding agent used in such a case lie generally at <100 μm.

The method according to the invention is preferentially utilized in the preparation of propellant charges for cartridgeless ammunition.

It can also basically be used in the preparation of propellant charges of conventional cartridge ammunition. At the same time, it is possible, for example, by extrusion molding and subsequent size reduction to subject the prepared granulates to the heat treatment according to the invention for the purpose of pore formation and use these granulates as propellant. If necessary, the individual granulates can be compressed to small tablets before heat treatment. It is also possible to subject the extrusions to the heat treatment according to the invention and use these extrusions as propellant for cartridge ammunition.

EXAMPLES 1 TO 6

The components α-octogen, hexanitrodiphenyl, polyvinyl-n-butyral (PVB) and ammonium hydrogen carbonate (AHC)were premixed dry in a container by means of a tumbler-mixer. The components were first dried and then by size reduction brought into a fine particle form.

This was followed by mixing in a kneader for a period of 30 minutes at ambient temperature in the presence of ethylacetate/toluol as binder solvent. Following this, the solvent wet material was extrusion-molded through a hole die at a pressure of 40 kp/cm$^2$. The number of holes amounted to 42, the hole diameter to 1 mm and the press diameter to 70 mm. After a short dessication of the solvent at ambient temperature, the extrusions are cut up into a granulate with a length of <1 mm. The sections are stored for three days at 0° C. and subsequently are exposed for three hours to a saturated environment of ethylacetate/acetone at ambient temperature. There then followed the processing into propellant pellets with a pressure of 1.8 Mp/cm$^2$ at ambient temperature. Following this, the pellets were left for three hours in a drying oven at 100° C. and standard pressure.

In a typical mixture, 176 g α-octogen with an average particle size of 17 μm was premixed dry with 16 g PVB with an average particle size of 26 μm, 8 g hexanitrodiphenyl and 20 g AHC with particle size <400 μm, kneaded with a mixture made of 80 ml ethylacetate and 12 ml toluol and, following this, processed as described above. The procedure can be the same when using AHC for the particle fraction <200 to >100 [μm].

The table depicts the dependency of ballistic results on the quantity and particle size distribution of the added AHC.

The comparison of Examples 4 to 6 with 1 to 3 shows the clear reduction of firing time (millisec) with the selection of a reduced particle size spectrum, the decrease of this time and the reduction of dispersion of projectile velocity with increasing quantity of AHC.

Further, the effect of porosity in a complete reaction can be seen. In contrast to this, pellets without porosity result in residues in the cartridge chamber and precipitations on a paper disk at a distance of 2 m in front of the gun muzzle.

| | Example No.: | | | | | |
|---|---|---|---|---|---|---|
| | 1 | 2 | 3 | 4 | 5 | 6 |
| I. Composition (weight in %) | | | | | | |
| α-octogen | 88 | 88 | 88 | 88 | 88 | 88 |
| Hexanitrodiphenyl | 4 | 4 | 4 | 4 | 4 | 4 |
| PVB (containing 2% by weight dicyclohexylphthalate as plasticizer) | 8 | 8 | 8 | 8 | 8 | 8 |
| AHC (addition to 100 parts by weight of propellant/binding agent mixture, parts by weight) | 7 | 10 | 13 | 7 | 10 | 13 |
| Particle size (μm) | <400 | <400 | <400 | >100 | >100 | >100 |
| Molding temperature (°C.) | 20 | 20 | 20 | 20 | 20 | 20 |
| Molding pressure (Mp/cm$^2$) | 1,8 | 1,8 | 1,8 | 1,8 | 1,8 | 1,8 |
| II. Ballistic results using a 4.7 mm caliber small arm | | | | | | |
| Maximum pressure (bar) | 4109 | 4002 | 4138 | 4192 | 4140 | 4055 |
| Firing time (millisec) | 1,83 | 2,08 | 1,80 | 1,61 | 1,49 | 1,44 |
| Velocity after 5 m (m/sec) | 981 | 967 | 962 | 984 | 977 | 964 |
| Standard deviation δ (m/sec) | 19 | 13 | 7 | 16 | 11 | 6 |

We claim:

1. A method for producing a porous propellant charge which comprises mixing a plurality of particles of a high temperature-resistant propellant having a decomposition temperature above 200° C. with a plurality of particles of a thermally removable filler to form a mixture containing said propellant particles and said filler particles, said filler being a solid material at ambient temperature and being a distillable or sublimable material which is removable by the effect of heat at elevated temperature and the concentration of the filler particles in said mixture being 1 to 30% by weight, based on the total weight of the mixture; molding the mixture into a charge body; and subsequently heating the charge body to an elevated temperature that is at least 50° C. below the decomposition of the high temperature-resistant propellant to effect removal of at least a part of the filler particles by distillation or sublimation, thereby creating a plurality of cavities within said body and forming a porous propellant charge.

2. A method according to claim 1, wherein the propellant comprises at least one secondary explosive in a form suitable as a propellant.

3. A method according to claim 1, wherein said high temperature resistant propellant comprises an organic nitro compound, a nitramine compound, or a nitrated heterocyclic compound having the heteroatoms N, O or S or a mixture of said compounds in a form suitable as a propellant.

4. A method according to claim 3, wherein octogen is the nitramine compound.

5. A method according to claim 1, wherein the particles of the filler have a particle in the range of from >100 to <200 μm, and particles of propellant have a particle size of <100 μm.

6. A method according to claim 1, wherein the mixture also contains a binding agent, said binding agent having a decomposition temperature above said elevated temperature.

7. A method according to claim 1 or claim 6, wherein the filler is ammonium carbonate, ammonium carbamate, ammonium hydrogen carbonate or a mixture thereof.

* * * * *